United States Patent [19]

Taylor et al.

[11] 4,119,825

[45] Oct. 10, 1978

[54] INDUCTION HEATING APPARATUS

[75] Inventors: Robert Graham Taylor, Charfield; William Alfred Proops, Bristol, both of England

[73] Assignee: Rolls-Royce (1971) Limited, United Kingdom

[21] Appl. No.: 632,666

[22] Filed: Nov. 17, 1975

[30] Foreign Application Priority Data

Dec. 3, 1974 [GB] United Kingdom ..... 52310/74

[51] Int. Cl.[2] ..... H05B 9/02

[52] U.S. Cl. ..... 219/10.73; 19/10.57; 219/10.75

[58] Field of Search ..... 219/10.41, 10.43, 10.57, 219/10.73, 10.79; 174/15 C, 15 R; 336/20, 60, 209

[56] References Cited

U.S. PATENT DOCUMENTS

| | | | |
|---|---|---|---|
| 1,493,713 | 5/1924 | Tykocinski-Tykociner | 336/20 |
| 2,397,442 | 3/1946 | Somes | 219/10.79 |
| 3,281,678 | 10/1966 | Cilyo | 336/20 X |
| 3,525,842 | 8/1970 | Steinhoff et al. | 219/10.79 X |
| 3,607,138 | 9/1971 | Keller | 219/10.79 X |
| 3,632,943 | 1/1972 | Engler et al. | 219/10.79 |

*Primary Examiner*—J. V. Truhe
*Assistant Examiner*—M. Paschall
*Attorney, Agent, or Firm*—Stevens, Davis, Miller & Mosher

[57] ABSTRACT

Induction heating apparatus for a dieless drawing operation includes a flexible induction coil made from a flexible metallic strip contained within an elastomeric sleeve which also defines a cooling fluid passage. The coil is sufficiently flexible to be capable of being formed into a shape which substantially conforms to that of a workpiece being heated at any point along the length of the workpiece. The apparatus of the invention also includes cam followers connected to the coil and cams which represent the shape of the workpiece over which the followers move during the heating operation to change the shape of the coil as required to maintain the coil at a substantially constant distance from the surface of the workpiece.

9 Claims, 3 Drawing Figures

INDUCTION HEATING APPARATUS

This invention relates to induction heating apparatus and relates more particularly to apparatus for applying local heating at successive points along the length of a workpiece which is of varying cross-section.

In connection with the dieless drawing to form metals by superplasticity, for example, solid or hollow blades for gas turbine engines, it is desirable to locally heat the workpiece, preferably by means of an induction coil, and to maintain the coil at a substantially constant distance from the workpiece around the periphery of the workpiece. As a workpiece is being drawn by this method in one direction, the heating means, i.e. the induction coil, moves in the opposite direction and when a twisted, non-constant aerofoil section blade is being drawn it is necessary for the induction coil to be deflected around its periphery to follow the changing shape of the workpiece as it is being drawn.

The present invention seeks to provide induction heating apparatus in the form of a flexible induction coil and to further provide means of manipulating such a coil which will meet the above requirements.

According to the invention there is provided induction heating apparatus comprising a flexible strip of an electrically conductive material which is adapted to be connected to a source of electrical energy, the strip being contained within the flexible sleeve which also defines a passage for the flow therethrough of a cooling medium, the combined strip and sleeve being wound to form an induction coil.

In a preferred arrangement, the conductive strip comprises a copper strip contained within an elastomeric sleeve which is arranged to receive a flow of water as the cooling medium. The supply of electrical energy may be of radio or medium frequency.

The induction heating apparatus may further comprise a workholder adapted for supporting a workpiece, means for supporting the induction coil so that it is capable of surrounding at least a portion of a workpiece when positioned in the workholder, and means for manipulating the coil to vary its shape so that the radially inner surface of the coil may be positioned at a substantially constant distance from the surface of the workpiece over a substantial part of that surface area of the workpiece which the coil is capable of surrounding.

In order that the coil can be manipulated to a given shape, during heating of a workpiece at different locations along its length, a plurality of plungers are attached to the periphery of the coil, each plunger being movable independently of the remaining plungers, for example, by means of cams shaped to represent the workpiece.

Figure 1:
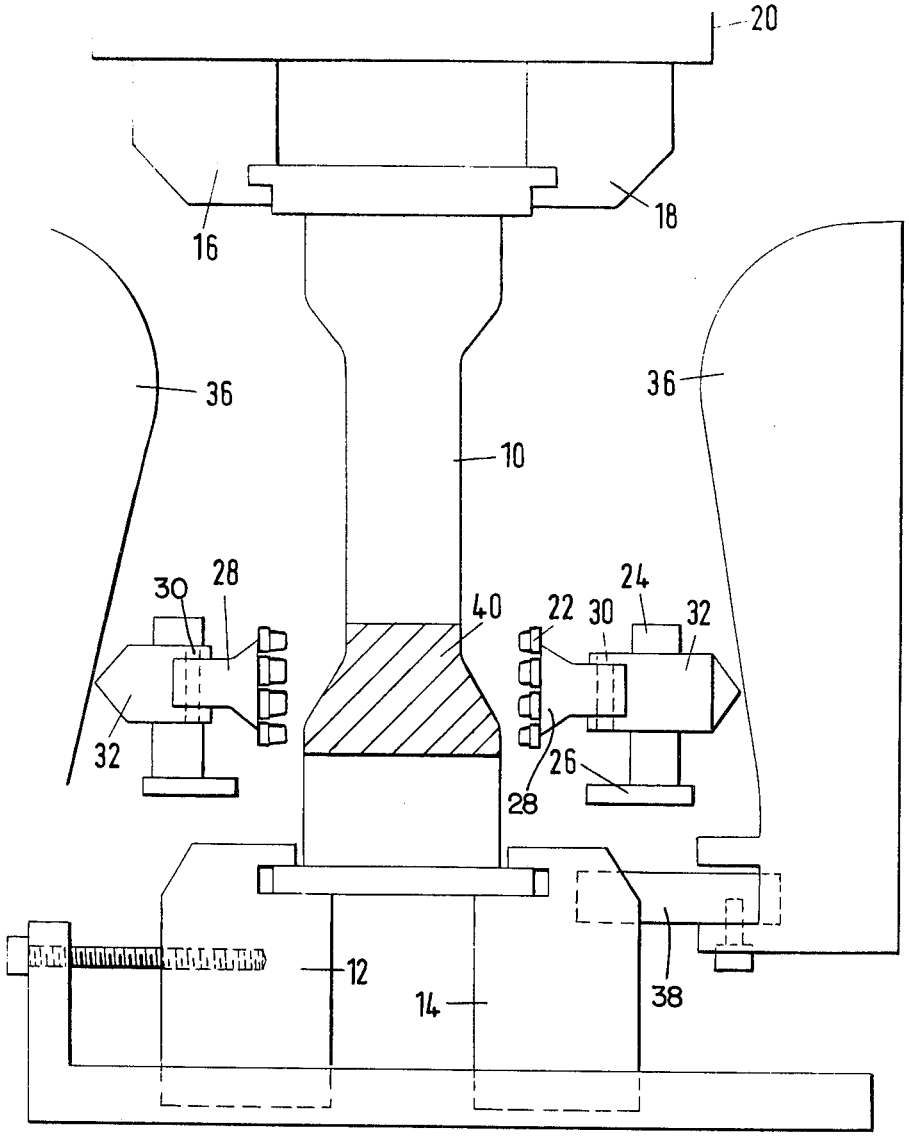
Figure 2:
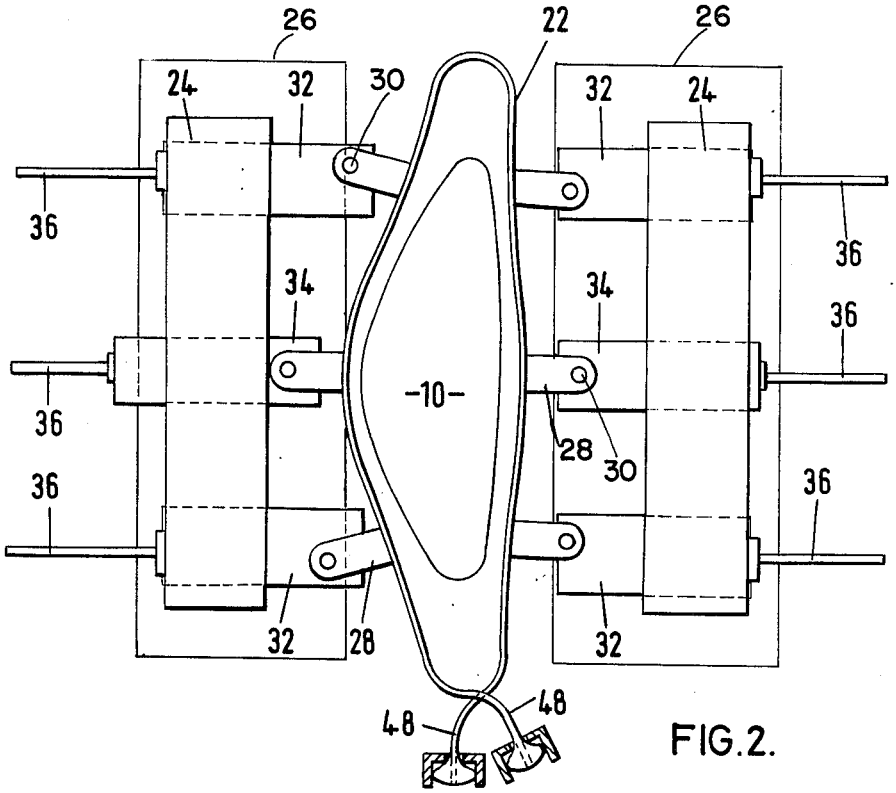
Figure 3:
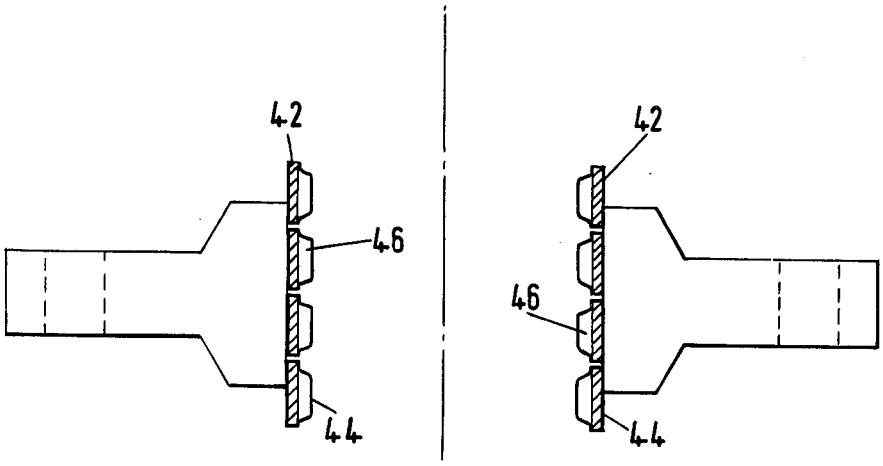

The invention will now be more particularly described with reference to the accompanying drawing in which:

FIG. 1 is an elevation of a dieless drawing machine incorporating one form of flexible induction coil according to the present invention, FIG. 2 is a part plan view of FIG. 1 showing the relationship of the coil and the workpiece, and, FIG. 3 is a section through the coil of FIG. 1 illustrating its construction.

Referring now to the drawings, in FIGS. 1 and 2 there is shown a machine adapted for dieless drawing operations and having a workholder which consists of a pair of jaws 12 and 14, capable of sliding on the machine base for clamping a workpiece.

A workpiece 10, which in this example is an aerofoil-shaped blade for a gas turbine engine, is clamped at one of its ends in the jaws and is held at the other end in a further pair of jaws 16 and 18 which are in turn mounted on a vertically movable carriage 20 of the machine. The carriage is a conventional part of the machine and is not described in detail. It is driven by the usual lead screw (not shown).

An induction coil 22 is mounted on a carrier 24 connected to a lower machine carriage 26 which is driven by a lead screw (not shown) to provide vertical movement of the coil relative to the blade. The carriage is again a conventional machine part and is not described in detail.

The coil is provided with six manipulating lugs 28, three on each side, which are connected by pins 30 to cam followers 32,34 which are arranged to contact the surfaces of cams 36 alongside the blade 10. The cams are fixed to a platen 38 which is carried by one of the jaws 14. The cam followers may be slidably mounted in the carrier 24 as the embodiment illustrated and spring urged towards the cams 36 or in an alternative embodiment (not shown) where a symmetrical blade is being drawn the carrier may be slidably mounted and the end cam followers on each side of the workpiece may form part of the carrier while only the central follower is independently movable.

In operation, as the workpiece is being drawn, the induction coil is moved downwards to heat the workpiece and to maintain the heated zone 40 of the workpiece in the correct place, while the upper carriage of the machine moves upwards to elongate the workpiece. As the shape of the blade changes along its length, the cam followers are moved transversely by the cam surfaces to exert pressure on the coil at the points of attachment of the six lugs to vary the shape of the coil to maintain a substantially constant distance between the coil and the surface of the workpiece. The distance for best operation of the process clearly varies for different workpieces and depends on current flows and the material of the workpiece but in general a distance of about three-sixteenths of an inch has been found to be typical.

The coil itself is shown in greater detail in FIG. 3 and consists of four turns of a flexible copper strip 42 which is 0.025 ins. thick and 0.25 ins. wide surrounded by a rubber sleeve 44 which also defines a cooling water passage 46. The coil is made by placing the copper strip alongside a mandrel of polytetrafluoroethylene (P.T.F.E.) and encasing them in a sleeve of a heat shrinkable fluorocarbon rubber, such as that sold under the Trade name VITON by the Raychem Corporation. The mandrel is arranged to have a slightly smaller width than the copper strip so that when the rubber sleeve is heated and shrinks it fits closely over the edges of the strip. The P.T.F.E. mandrel is removed from the sleeve after shrinking to leave the required space for a water cooling passage.

The ends of the sleeve are formed with brass pipe fittings 48 which act as fluid supply connections and electrical connectors for the copper strip.

In order to carry out the heating process a supply of radio frequency (r.f.) current is fed to the coil, along with the cooling water supply.

Since the r.f. current stays almost wholly in the radially inner surface of the coil the thickness of the strip is of little consequence for electrical purposes and can be optimised for maximum flexibility compatible with the required strength. Also, use of a strip according to the invention gives maximum flexibility in the transverse direction while allowing considerable surface area for the cooling water flow in proportion to the volume of the strip thus increasing the temperatures at which the coil can operate without the rubber sleeve breaking down.

Although r.f. current has been specified it is envisaged that for some heating operation a medium frequency (m.f.) current may be used, particularly at the higher frequency end of the range.

The coil is wound with the cooling water passage on the inside, so that in operation the rubber sleeve facing the heated workpiece is cooled and the temperature of operation can be maximised without breakdown of the rubber.

It has also been found that with a workpiece having very small radii at its transverse ends, there is a focussing effect of the current at the transverse ends of the coil which produces greater heating of the ends of the workpiece than on the flanks. This means that the distance between the workpiece and the coil at the tansverse ends has to be greater and this must be allowed for in the coil design and on the cams which cause the changes in coil shape.

We claim:

1. Induction heating apparatus comprising a workholder adapted for supporting a workpiece;

a flexible induction coil surround said workpiece in said workholder, said coil comprising a thin, flexible strip of an electrically conductive material and a flexible sleeve surrounding said strip and defining adjacent at least one surface of the strip a passage for the flow therethrough of a cooling medium;

means for connecting the coil to a source of electrical energy;

means for causing relative movement of the coil and workpiece along the length of the workpiece;

cam means spaced from said workpiece, and cam follower means connected to said coil and engaging said cam means, said coil being of constant length adapted to contortion under the biasing of said cam means acting through said follower to encompass a variety of areas of different and irregular magnitude as said coil moves relative to the length of said workpiece whereby the coil may be maintained in a configuration corresponding substantially to that of the cross-section of the workpiece as the coil traverses the workpiece.

2. Induction heating apparatus as claimed in claim 1 wherein said cam means are positioned along the length of the workpiece so that the radially inner surface of the coil may be positioned at a substantially constant distance from the surface of the workpiece while the workpiece is being heated at various locations along its length.

3. Induction heating apparatus as claimed in claim 1 the electrically conductive strip is a metallic strip and the sleeve is an elastomeric sleeve.

4. Induction heating apparatus as claimed in claim 1 the passage for the cooling medium is on the radially inner side of the coil.

5. Induction heating apparatus as claimed in claim 3, wherein the sleeve is made from a heat shrinkable fluorocarbon rubber which is shrunk over both the strip and a removable mandrel so that on removal of the mandrel there is formed the passage of the cooling medium and the strip is located therein.

6. Induction heating apparatus comprising a flexible induction coil adapted to surround a workpiece to be heated, said coil comprising a thin, flexible strip of an electrically conductive material and a flexible sleeve surrounding said strip and defining adjacent at least one surface of the strip a passage for the flow therethrough of a cooling medium, and means for connecting the coil to a source of electrical energy, said coil being of constant length adapted to contortion to encompass a variety of areas of different and irregular magnitude as said coil moves relative to the length of said workpiece whereby the coil may be maintained in a configuration corresponding substantially to that of the cross-section of the workpiece as the coil traverses the workpiece.

7. Induction heating apparatus as claimed in claim 6, wherein the electrically conductive strip is a metallic strip and the sleeve is an elastomeric sleeve.

8. Induction heating apparatus as claimed in claim 6, wherein the passage for the cooling medium is on the radially inner side of the coil.

9. Induction heating apparatus as claimed in claim 6, wherein the sleeve is made from a heat shrinkable fluorocarbon rubber which is shrunk over both the strip and a removable mandrel so that on removal of the mandrel there is formed the passage for the cooling medium and the strip is located therein.

* * * * *